US005694889A

United States Patent [19]

Ball et al.

[11] Patent Number: 5,694,889

[45] Date of Patent: Dec. 9, 1997

[54] ELECTRICAL GENERATOR SET

[76] Inventors: Ronald C. Ball, 3639 Haven Ave., Menlo Park, Calif. 94025; William A. Eldredge, P.O. Box 5457, Redwood City, Calif. 94063

[21] Appl. No.: 593,248

[22] Filed: Jan. 29, 1996

Related U.S. Application Data

[63] Continuation-in-part of Ser. No. 436,768, May 8, 1995, Pat. No. 5,515,816.

[51] Int. Cl.[6] ..... F02B 63/04

[52] U.S. Cl. ..... 123/41.7; 290/1 B

[58] Field of Search ..... 123/41.63, 41.65, 123/41.7; 290/1 B

[56] References Cited

U.S. PATENT DOCUMENTS

| | | | |
|---|---|---|---|
| 2,209,363 | 7/1940 | Sutherland | 290/1 B |
| 2,355,208 | 8/1944 | Devol et al. | 290/1 B |
| 4,608,946 | 9/1986 | Tanaka et al. | 132/2 |
| 4,647,835 | 3/1987 | Fujikawa et al. | 290/1 B |
| 4,827,147 | 5/1989 | Mizushima | 290/1 B |
| 4,835,405 | 5/1989 | Clancey et al. | 290/1 B |
| 4,856,470 | 8/1989 | Ishii et al. | 123/195 C |
| 4,859,886 | 8/1989 | Tanaka et al. | 290/1 B |
| 4,907,546 | 3/1990 | Ishii et al. | 290/1 B |
| 5,408,957 | 4/1995 | Crowley | 123/27 GE |
| 5,515,816 | 5/1996 | Ball et al. | 123/41.7 |

FOREIGN PATENT DOCUMENTS

| | | | |
|---|---|---|---|
| 59-74327 | 4/1984 | Japan | 123/195 C |

*Primary Examiner*—David A. Okonsky
*Attorney, Agent, or Firm*—Paul F. Schenck

[57] ABSTRACT

The compact electrical generator sets have separate cooling airflows for the cylinder of the driving internal combustion engine, for the electrical generator, and for the components which generate most of the heat. Providing separate airflows allows to reduce the size of the generator set. Use of an alternator and an electronic controller for converting the electrical energy generated by the alternator to electrical energy of the type required by the user simplifies the design. The design of the cooling airflow with multiple combined and separated airflows reduces both size of the generator set and reduces losses due to generating the airflows.

5 Claims, 7 Drawing Sheets

ELECTRICAL GENERATOR SET

This is a continuation-in-part application of my patent application Ser. No. 08/436,768, filed May 8, 1995, now U.S. Pat. No. 5,515,816, status allowed.

BACKGROUND OF THE INVENTION

The present invention relates to motor-generator sets for generating electrical energy. The present invention provides for a very compact implementation with low noise level. A first design offers a low profile package with easy access to all components, thereby providing very easy maintainability. A second design includes an open package with a high efficiency electrical generator.

SHORT DESCRIPTION OF THE INVENTION

In the first implementation of the present invention a small air-cooled horizontally mounted diesel engine is used to drive an electrical generator via a coupling. The enclosure includes several cooling air intakes, hot air and exhaust air outlets. In the second implementation a small liquid cooled vertically mounted engine is used to drive an electrical generator via a coupling. The new principle of airflow direction is used to supply sufficient and dedicated cooling air to the various components. By separating the various airflows noise normally connected with high speed airflow is reduced. Surrounding the exhaust of the engine by used cooling air reduces the temperature of the exhaust fumes.

OBJECTS OF THE INVENTION

It is an object of the invention to provide for a motor generator set with a low profile.

It is another object of the invention to provide for a multi-airflow cooling system in electrical generator sets.

It is another object of the invention to provide for a quiet sound-reducing electrical generator set.

It is still another object of the invention to provide for a power unit with uni-body construction and easy access for maintenance.

It is still another object of the invention to provide for a light weight power unit using a liquid cooled engine in an open package.

SHORT DESCRIPTION OF THE FIGURES

DESCRIPTION OF THE FIRST PREFERRED EMBODIMENT

Figure 1:
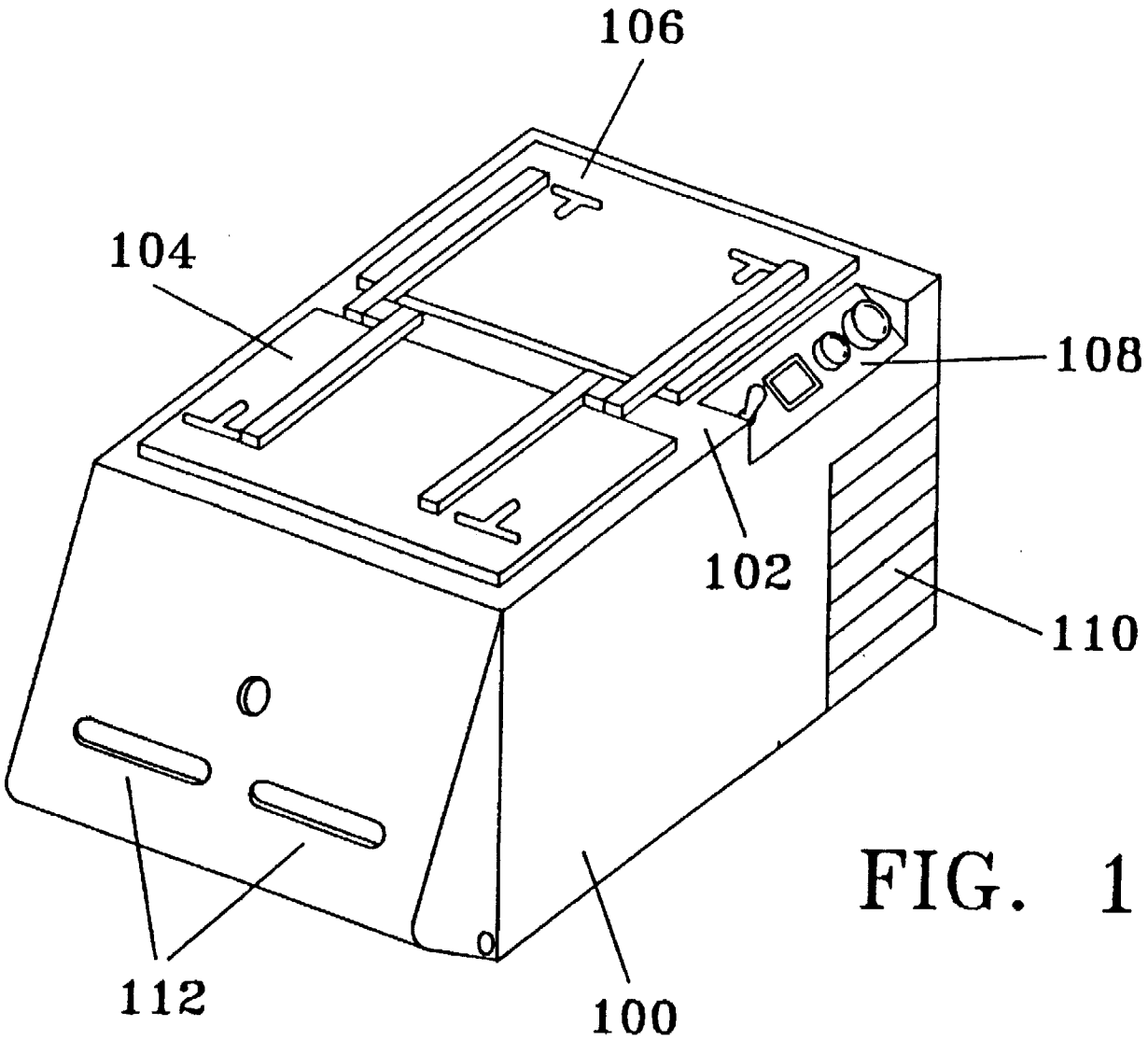
FIG. 1 is an illustration of a Diesel engine driven generator set of the present invention.

FIG. 1 is an illustration of a Diesel engine driven generator set of the present invention. The enclosure of the generator set includes uni-body section 100 with a cover 102 having two lids 104 and 106. A control panel 108 is provided to operate the generator set without having to open lids 104 and 106. Uni-body section 100 has an air intake opening 110 and second air intake openings 112. Air entering the generator set through opening 110 is used to cool the cylinder of the engine which drives the electrical generator and for cooling the electrical generator, as will be disclosed in detail with reference to FIG. 3. A part of the same intake air is used by the engine itself. Second air intakes 112 provide cooling air for the general interior, including the oil pan of the driving engine. If required, these openings 112 may provide also cooling air for a separate oil cooler of the driving engine inside uni-body 100.

In the preferred embodiment cover 102 is attached to uni-body by screws in a conventional manner. Cover 102 includes a center spar to which the hinges of lids 104 and 106 are linked. The ends of the center spar are affixed to opposing side walls of enclosure 100. The center spar is of sufficient strength so that a lifting hook may be attached for moving the generator set.

Figure 2:
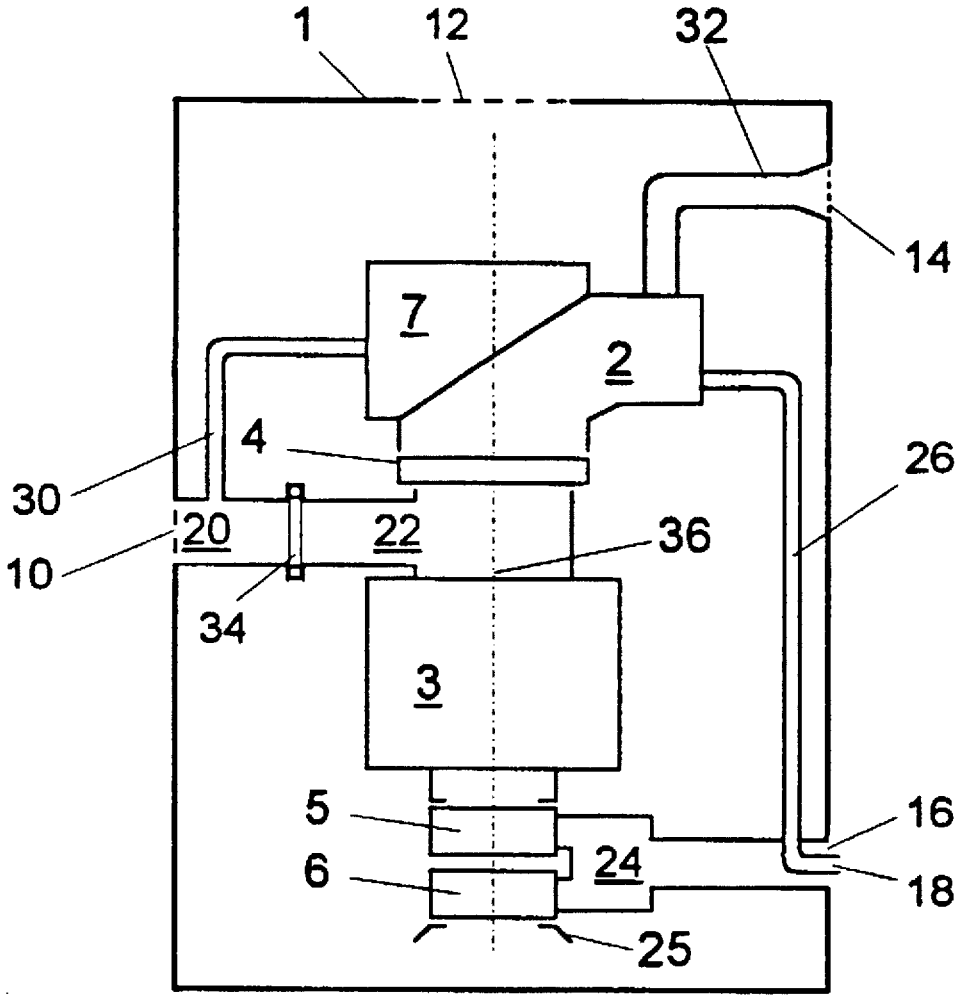
FIG. 2 is a schematic illustration of diesel engine 7 driven generator set of the present invention.

FIG. 2 is a schematic illustration of the airflow distribution in the system of the present invention. The diesel generator set of the present invention is mounted inside a main enclosure 1. The Set consists of a flat diesel engine 7, partially enclosed in a shroud 2, coupled to an electrical generator enclosed in a generator enclosure 3. Shroud 2 guides a cooling airflow to the cylinder of diesel engine 7. Reference 36 relates to the common axis of the drive shaft of the internal combustion engine and the shaft of the electrical generator. A first air blower 4, which is a flywheel with appropriate blower blades, is mounted on the drive shaft of diesel engine 7 inside shroud 2. A second air blower 5 and a third air blower 6 are mounted on the free end of the shaft of the electrical generator inside generator enclosure 3. Second air blower 5 and third air blower 6 are radial type blowers and are mounted back to back, which allows to deliver air from two different sources into the same chamber 24, i. e. from inside of generator enclosure 3 and from the interior of main enclosure 1 but outside of shroud 2 and generator enclosure 3. Blower 5 controls the airflow through generator enclosure 3. Blower 6 has a shroud 25 as an intake means and moves air from the interior of enclosure 1 to mixing chamber 24. The combined airflows of blowers 5 and 6 exit via pipe 16 to outside of envelope 1. The cooling air of diesel engine 7 enters chamber 20 through opening 10, moves into chamber 22. Cooling air in chamber 22 is separated into an airflow for cooling diesel engine 7 and an airflow for cooling the electrical generator covered by shroud 3. The cooling air for diesel engine 7 inside shroud 2 is accelerated by axial blower 4 and exits via pipe 32 through a separate opening 14 in enclosure 1. Diesel engine 7 receives combustion air for operation from chamber 20 via pipe 30. Exhaust fumes are passing through pipe 26 to the outside of enclosure 1. However, pipe 26 is led into cooling air outlet 16 so that the hot diesel exhaust fumes exiting from free end 18 of pipe 26 are enveloped by cooler air of outlet 16. This combined outlet for cooling air and diesel exhaust fumes reduces the temperature of the exhaust fumes and reduces the speed differential between the diesel exhaust fumes and the air outside enclosure 1, thereby reducing also the noise level.

Third air blower 6 draws air from the inside of main enclosure 1. This air enters the inside of main enclosure through an intake 12 and flows around the crankshaft case, the oil pan of engine 7 and shroud 2 cooling parts of diesel engine 7, and generator enclosure 3. Passing through blower 6, which has an intake shroud 25, this third airflow 66 joins the cooling airflow from the electrical generator in plenum chamber 24. At the location where exhaust pipe 26 enters pipe 16 cooling air from blowers 5 and 6 envelops pipe 26. Outside enclosure 1 cooling air exiting at opening 16 envelops exhaust fumes exiting from exhaust pipe opening 18.

Figure 3:
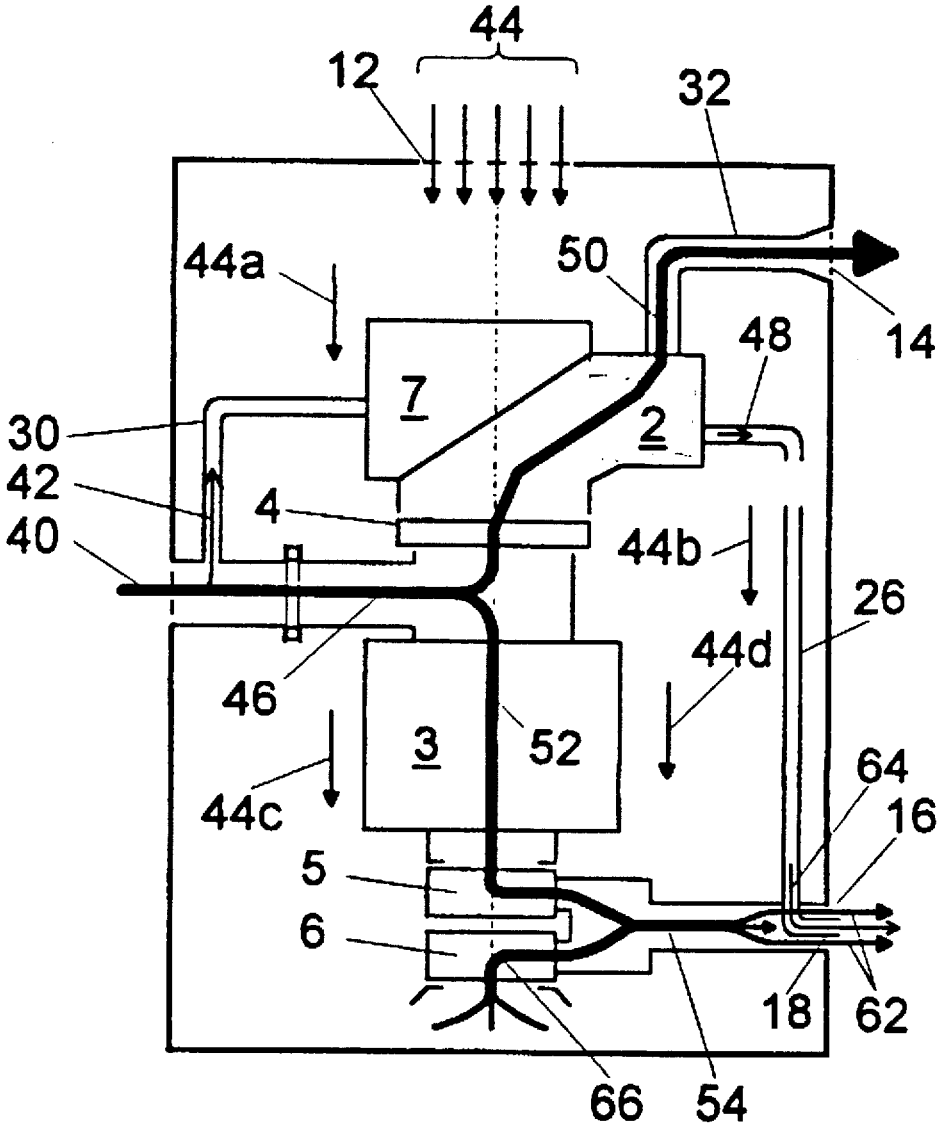
FIG. 3 is a schematic illustration of the airflow distribution in the system of the present invention.

FIG. 3 is a schematic illustration of the airflow of the generator set. There are three major airflows. The first airflow 50 is used to cool the cylinder walls of the internal combustion engine inside shroud 2. The second airflow 52 is used to cool the generator inside generator enclosure 3. First and second airflows are derived from the same airflow 46, which enters the main enclosure as airflow 40. Airflow 40 also includes the supply of combustion air 42 needed by the combustion engine 7. The amount of throughput of first airflow 50 and second airflow 52 is mainly determined by the selection of first blower 4 and second blower 5 and the airflow obstructions in the paths of these airflows.

The third air blower 6 generates airflow 66 from the inside of main enclosure 1. The air of airflow 66 enters the inside of main enclosure 1 through intake 12 as airflow 44 and flows around the crankshaft case, the oil pan of engine 7 and shroud 2 cooling parts of diesel engine 7, and generator enclosure 3 as indicated by arrows **44*a* through 44*d*. Passing through blower 6 this third airflow 66 joins the cooling airflow 52 from the electrical generator in plenum chamber 24. At the location where exhaust pipe 26 enters pipe 16 the combined airflow 54 from blowers 5 and 6 envelops pipe 26 as airflows 62. Outside enclosure 1 cooling air exiting from opening 16 envelops exhaust fumes 64 exiting from exhaust pipe opening 18. Exhaust fumes 48 of diesel engine 7 are already cooled by airflow 62 in flow area 64** before the fumes are released.

Engine 7 may have an additional oil cooler mounted closely against a wall of main enclosure 1. This oil cooler may include a separate air blower. Cooling air for the oil cooler can be diverted from airflow 44 and released through an separate opening to the outside of main enclosure 1. The additional cooling airflow for the oil cooler would reduce the thermal load on airflows **44*a* through 44*d*** and increase the total number of airflows to four.

Figure 4:
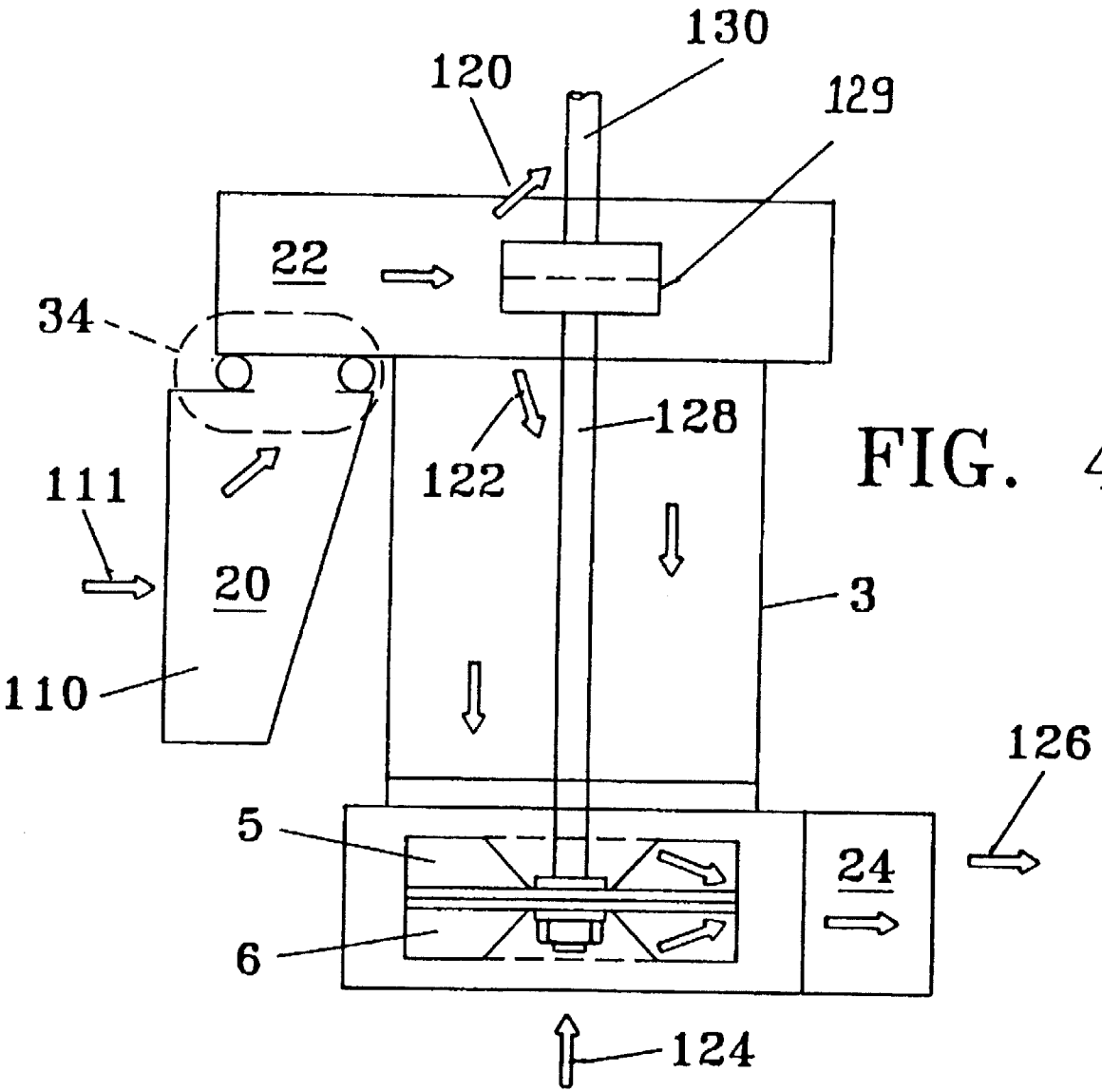
FIG. 4 is another schematic illustration of the dual air-blower unit used for mixing cooling air of the electrical generator and the general internal cooling air of the unit.

FIG. 4 is another schematic illustration of the dual air-blower unit used for mixing cooling air of the electrical generator and the general internal cooling air of the unit. Air 111 entering the generator set through intake 110 is collected in chamber 20, which is affixed to uni-body 100 (FIG. 1). The air is then entering chamber 22. Chamber 22 is affixed to the combination of engine 7 and generator enclosure 8. Chambers 20 and 22 have an interface 34 which allows near air-tight relative movement between chambers 22 and 24. In chamber 22 cooling air is split into one airflow 120 which cools the cylinder wall of the driving engine and a second cooling airflow 122 for cooling the electrical generator inside shroud 3. An air blower 5 control airflow 122 and accelerates the air cooling the electrical generator into mixing chamber 24. Air blower 6 collects cooling air 124 from the interior of uni body 100 and accelerates this air into mixing chamber 24. Air of the combined cooling airflow 126 leaves uni-body 100 through opening 16.

As shown in FIG. 4 air blowers 5 and 6 are mounted on the free end of shaft 128 of the electrical generator inside shroud 3. This shaft is coupled to drive shaft 130 of the driving engine by coupling 129. In FIGS. 2 and 3 these shafts are represented by common axis 36.

The use of a flat engine in combination of a direct coupled electrical generator and the use of a plurality of appropriately dimensioned cooling airflows allows to reduce the overall size of the space required for the generator set and thereby reducing the size of the main enclosure, especially the height of the main enclosure.

While the specification of the first preferred embodiment discloses a diesel generator set, it is considered to be within the skills of the common practitioner to select an internal combustion engine of a different type to drive the generator without departing from the spirit of the present invention.

DESCRIPTION OF THE SECOND PREFERRED EMBODIMENT

Figure 5:
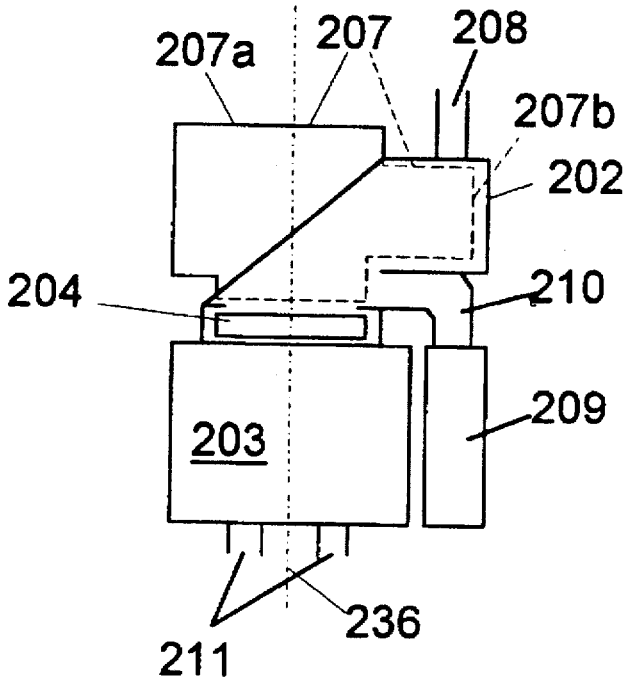
FIG. 5 is a schematic illustration of a generator set with a single air blower and multiple airflow cooling system using an air cooled internal combustion engine.
Figure 6:
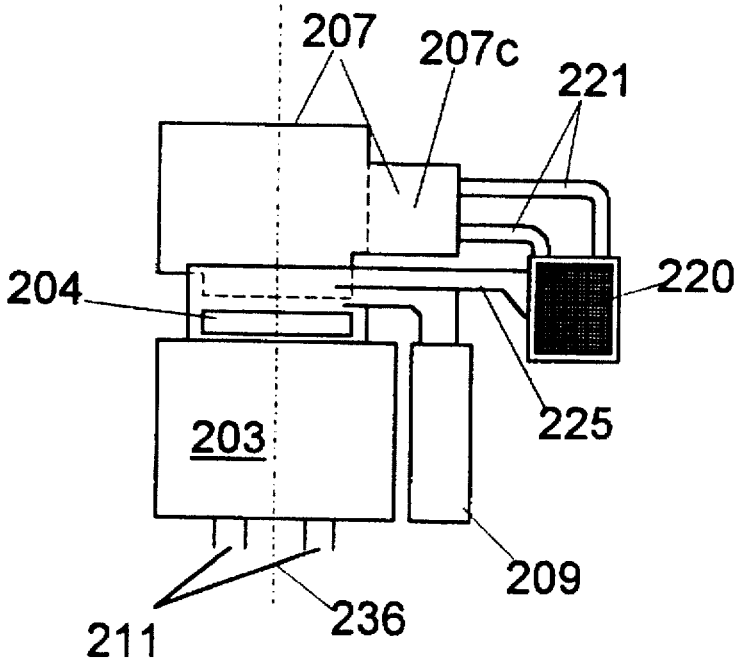
FIG. 6 is a schematic illustration of a generator set wit a single air blower and a multiple air flow cooling system using a water cooled internal combustion engine.

FIG. 5 is a schematic illustration of a generator set using an air cooled internal combustion engine 207 to drive a high efficiency electrical generator 203. Engine 207 and generator 203 are directly coupled. Line 236 represents the axes of the driving shaft of engine 207 and the driven shaft of generator 203. An air blower wheel 204 is mounted either on the driving shaft of engine 207 or on the driven shaft of generator 203, thus is positioned on the same axis 236. This blower wheel is functioning as a flywheel and has fans for generating an axially directed forced air flow. Engine 207 may be a diesel engine, as disclosed in the earlier section of this specification or an air cooled engine using other conventional means for ignition of a combustable fuel mixture. To control the flow of the forced air around the cylinder the cylinder head is encapsuled by a shroud 202 which guides a part of the forced air towards cylinder head **207*b*. Cooling fins of cylinder head 207*b* then guide the cooling air towards air exit 208 of shroud 202**.

Electrical generator 203 is a high efficiency alternater type which supplies alternating current to an electronic section in enclosure 209. The electronic section transforms the supplied alternating current into a stabilized alternating current with a desired voltage and/or a stabilized direct current with a desired voltage. For cooling the electronic section a part of the forced air flow is diverted by a separate air duct 210 and passes through enclosure 209.

Electrical generator 203 has a rotor with permanent magnets and openings for passing cooling air through the rotor. The stator of the electrical generator carries the electrical windings and includes sufficient openings to let cooling air pass through. Two openings 211 in the bearing shield of electrical generator 203 (far side from the driving engine 207) allows air to enter electrical generator 203. This air flow is caused by the suction of air blower wheel 204. The suction capability has to provide sufficient air to cool cylinder head 202 of engine 207 and to cool the electronic section in enclosure 209.

Figure 7:
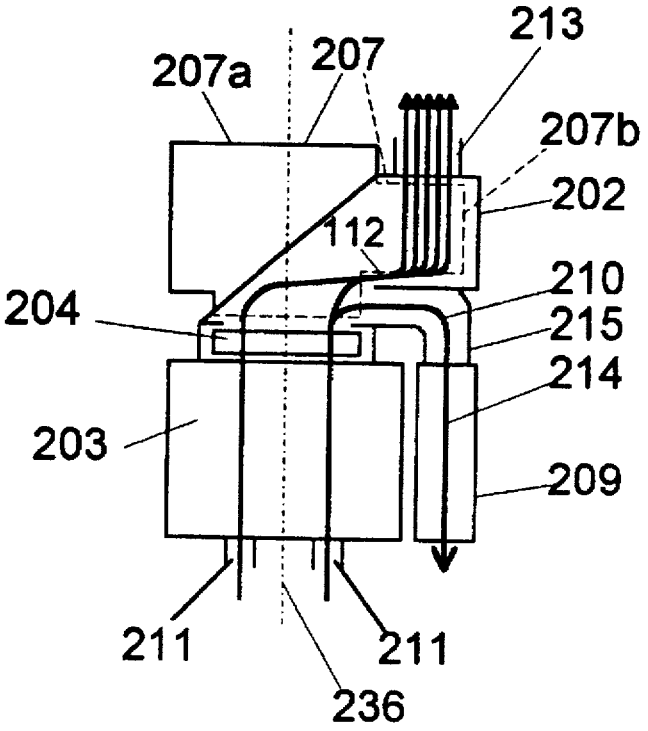
FIGS. 7 and 8 are schematic illustrations showing the air flow stream of the generator sets of FIGS. 5 and 6, respectively.

FIG. 7 is a schematic illustration of the air flow in an arrangement just disclosed with respect to FIG. 5. Air entering generator 203 through openings 211 forms inside generator 203 a combined air flow through the stator and through the rotor of generator 203. This combined air flow passes through blower wheel 204 and is split into a first air flow 212 which is guided by shroud 202 towards cylinder head, where it is split by the cooling fins of cylinder head **207*b* into a plurality of parallel air flows, which leave shroud 202 through opening 213**.

The second air flow 214 is guided by air duct 210 into enclosure 209 and exiting enclosure 209 after passing over the electronic section.

Figure 8:
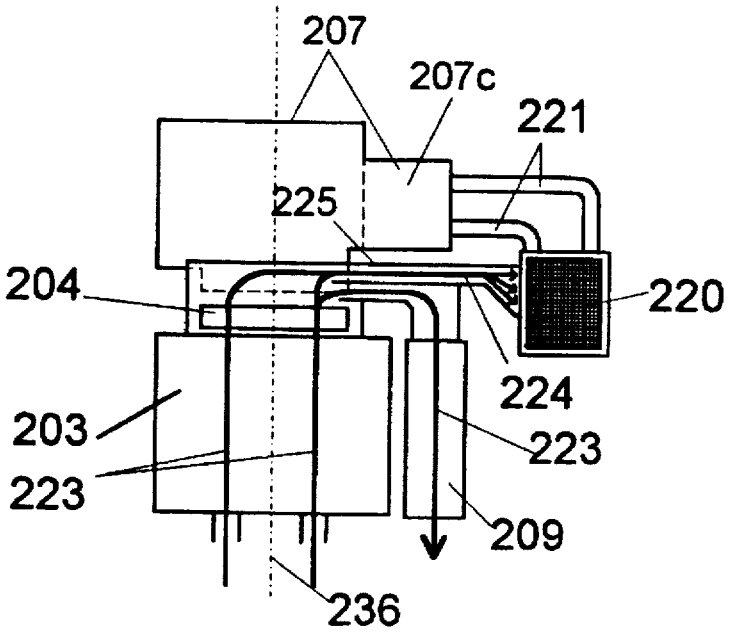

FIG. 8 is a schematic illustration of the cooling air flow of a generator set using a liquid coolant for cooling the cylinder head of the driving engine. The cylinder head 207*c* includes channels for passing the coolant from an input port to an output port, to which there is connected a radiator 220 using hoses or pipes 221. A coolant pump may be interconnected in this circulation system, however for simplification it is not included in the schematic illustrations. A part 222 of the airflow 223 which passed through the electrical generator 203 and fan 204 is guided to radiator 220 to assist in cooling the coolant. Another part 224 of airflow 223 is guided by air duct 225 into enclosure 209 and exiting enclosure 209 after passing over the electronic section.

Figure 9:
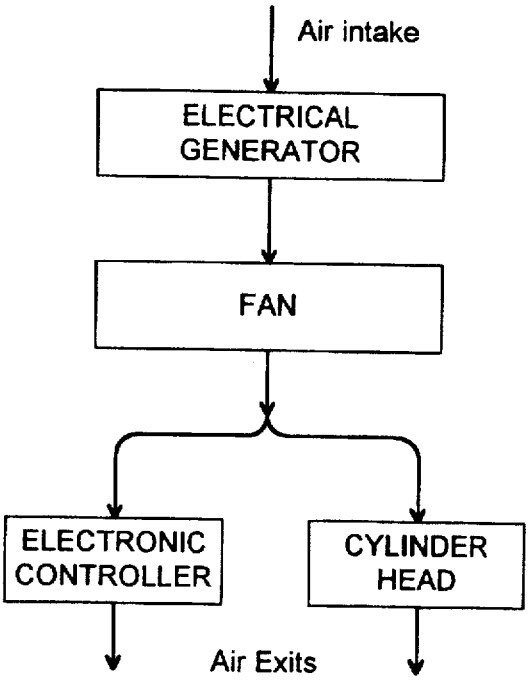
FIGS. 9 and 10 are schematic illustrations of the cooling arrangement of the second preferred embodiment.
Figure 10:
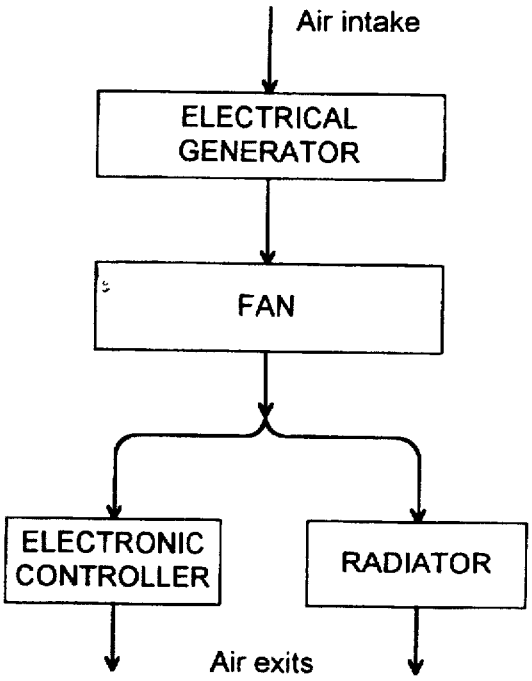

FIGS. 9 and 10 are schematic illustrations of the cooling arrangements of the second preferred embodiments of the present invention. FIG. 9 related to a generator set using an air cooled engine, FIG. 10 relates to a generator set using a liquid coolant engine. The two arrangement differ in the direct cooling of the cylinder head by a part of the forced air flow versus the use of a part of the forced airflow for inderict coolin using a liquid coolant as intermediate transfer medium. The arrangment of the present invention provides for easy adaptability to the required cooling of the engine. The air cooled cylinder head is used in low power applications, the liquid coolant cylinder head is used for higher power requirements. All major components remain unchanged.

The use of a universal alternator and an electronic controller for transforming the alternating current produced by the alternator into the required type of electric power allows to adapt the generator set to the particular application. E.G., in an application as an emergency power unit it could serve as a 120 VAC power source with a battery charging facility at 12 VDC, or even as an emergency starter for cars.

It is considered within the skills of the artisan in this field of technology to use diesel engines, gasoline engines, four-stroke- or two-stroke type of engines.

What is claimed is:

1. An internal combustion engine generator set comprising a frame structure having mounted therein an internal combustion engine having a cylinder, a crankshaft and a drive shaft, an electrical generator directly coupled to said drive shaft of said internal combustion engine, an electrical controller;

said electrical generator having a rotor mounted on a driven shaft and having means for generating a magnetic field, a stator including windings for generating an electrical current, said rotor and said stator including openings for passing cooling air in axial direction means for generating an air flow, means for dividing said cooling air having past through said generator into a first and a second cooling air stream, first means for cooling said cylinder using said first cooling air stream, an airflow duct for cooling said electrical controller using said second cooling air stream.

2. An internal combustion engine generator set as claimed in claim 1, wherein said means for generating an airflow includes a fan mounted on said drive shaft and receiving air for providing said air flow through said openings in said electrical generator.

3. An internal combustion engine generator set as claimed in claim 1, wherein said internal combustion engine includes a liquid cooled cylinder head, wherein said means for cooling said cylinder include a cooling fluid and a radiator connected to said cylinder for cooling said cooling fluid, and wherein said first cooling air stream is passed through said radiator.

4. An internal combustion engine generator set as claimed in claim 1, wherein said internal combustion engine includes an air cooled cylinder head, wherein said means for cooling said cylinder head includes cooling ribs, an air duct and a cylinder head enclosure, and wherein said first cooling air stream is directed through said air duct into said cylinder head enclosure along said cooling ribs.

5. An internal combustion engine generator set as claimed in claim 1, wherein said electrical controller provides electrical energy supplied by said generator as an alternating current of a first voltage and a direct current of a second voltage.

* * * * *